US007037130B2

(12) United States Patent
Dillon

(10) Patent No.: US 7,037,130 B2
(45) Date of Patent: May 2, 2006

(54) ELECTRICAL CONNECTOR ASSEMBLY

(75) Inventor: Christopher Dillon, Dearborn Heights, MI (US)

(73) Assignee: J.S.T. MFG. Co., Ltd., (JP)

( * ) Notice: Subject to any disclaimer, the term of this patent is extended or adjusted under 35 U.S.C. 154(b) by 0 days.

(21) Appl. No.: 10/776,026

(22) Filed: Feb. 10, 2004

(65) Prior Publication Data

US 2005/0176297 A1 Aug. 11, 2005

(51) Int. Cl.
*H01R 13/627* (2006.01)

(52) U.S. Cl. ..... 439/357; 439/489

(58) Field of Classification Search ..... 439/357, 439/489, 350

See application file for complete search history.

(56) References Cited

U.S. PATENT DOCUMENTS 4,433,888 A * 2/1984 Winger ..... 439/328
4,657,331 A * 4/1987 Coldren ..... 439/571
5,190,467 A * 3/1993 Ohta ..... 439/354
5,203,719 A * 4/1993 Kozono ..... 439/489
5,257,944 A * 11/1993 Kennedy ..... 439/347

* cited by examiner

*Primary Examiner*—Javaid H. Nasri
(74) *Attorney, Agent, or Firm*—Osha Liang LLP

(57) ABSTRACT

When a latch element is inserted in an opening of a first connector element, a cantilevered flexible portion of the latch element is retained in and latchingly engaged with the first connector element at a deflectable end portion of the cantilevered flexible portion. When the second connector element is inserted in and mated with the first connector element, the deflectable end portion of the cantilevered flexible portion is deflected in a direction orthogonal to the insertion/mating direction of the second connector element to force the deflectable end portion of the cantilevered flexible portion to move in the direction orthogonal to an insertion/mating direction, so as to release the retention of the latch element with the first connector element, thereby rendering the latch element movable in an insertion direction thereof.

9 Claims, 9 Drawing Sheets

ELECTRICAL CONNECTOR ASSEMBLY

BACKGROUND OF THE INVENTION

1. Technical Field of the Invention

The present invention relates to an electrical connector assembly comprising a first connector element supporting first connector terminals, a second connector element supporting second connector terminals and being to be mated with the first connector element, and a latch element latchingly engaged with the first connector element.

2. Description of the Prior Art

The electrical connector assembly comprising the first connector element supporting the first connector terminal, the second connector element supporting the second connector terminal and being to be mated with the first connector element, and the latch element to latchingly engage with the first connector element is generally known. For example, an electrical connector assembly described in U.S. Pat. No. 5,257,944 is known as a typical one. This electrical connector assembly is designed so that a male electrical connector (second connector element) is mated with a female electrical connector (first connector element). The male and female electrical connectors are each provided with a plurality of terminals. Also, the latch element, which is called a connector position assurance (CPA), is inserted in and latchingly engaged in the female electrical connector. The latch element is provided with a loop-like portion formed in a planar shape (loop portion). When the male electrical connector is inserted in and mated with the female electrical connector latchingly engaging with the latch element, the male electrical connector is forced to contact with the loop portion of the latch element. Then, the loop portion of the latch element is deflected in the insertion/mating direction of the male electrical connector to release the retention of the latch element in the female electrical connector, allowing movement of the latch element in the insertion direction. Then, a projected boss of the male electrical connector is mated with a recessed portion formed in the latch element, with which the mating engagement between the male electrical connector and the female electrical connector is completed. The latch element is not allowed to move until the male electrical connector is inserted in and mated with the female electrical connector, from which one can confirm the proper mating engagement therebetween.

In the electrical connector assembly mentioned above, the retention of the latch element in the first connector element (female electrical connector) is released via the deflection of the planar loop portion of the latch element in the insertion/mating direction of the second connector element (male electrical connector) which is parallel with the plane of the latch element. Due to this, a force sufficient to deflect the loop portion of the latch element must be applied to the second connector element when inserted in and mated with the first connector element, thus involving difficulties in the mating work. Besides, the second connector element must be kept on pressing until the end of operation for the mating engagement. If not, the second connector will be thrust back by a resilient restoration force of the deflected loop portion of the latch element. This makes it difficult to release the retention of the latch element in the first connector element, then making it more difficult to perform the operation for the mating engagement.

SUMMARY OF THE INVENTION

It is an object of the present invention to provide an electrical connector assembly excellent in workability that can allow easy release of the retention of the latch element in the first connector element to move the latch element in the insertion direction when the second connector element is inserted in and mated with the first connector element.

In accordance with one aspect of the present invention, there is provided an electrical connector assembly comprising:

a first connector element supporting first connector terminals, a second connector element supporting second connector terminals to be electrically connected with the first connector terminals and being to be inserted in and mated with the first connector element, and a latch element having a cantilevered flexible portion supported at one end portion and projected to be freely deflectable at the other end portion so that when the latch element is inserted in an opening formed in the first connector element, the other end portion of the cantilevered flexible portion is mated with and latchingly engaged in the first connector element, wherein when the second connector element is inserted in and mated with the first connector element latchingly engaging with the latch element, the cantilevered flexible portion is contacted with the second connector element and is deflected to force the other end portion of the cantilevered flexible portion to move in a direction orthogonal to an insertion/mating direction of the second connector element, so as to release the engagement of the latch element with the first connector element, thereby rendering the latch element movable in an insertion direction thereof.

According to this construction, the latch element is retained in and latchingly engaged with the first connector element at the other end portion of the cantilevered flexible portion, so that when the second connector element is fitted in the first connector element, the cantilevered flexible portion is abutted with the second connector element and is deflected to force the other end portion of the cantilevered flexible portion to move in a direction orthogonal to the insertion/mating direction of the second connector element. This can allow release of the retention of the first connector element and the cantilevered flexible portion, rendering the latch element movable in the insertion direction. Thus, since the engagement releasing direction of the latch element is orthogonal to the insertion/mating direction of the second connector element, interference with the resilient restoration force of the latch element at the time of insertion of the second connector element can be suppressed drastically. This can produce an electrical connector assembly excellent in workability that can allow easy release of the retention of the latch element in the first connector element to move the latch element in the insertion direction when the second connector element is inserted in and mated with the first connector element.

These and other objects, features, and advantages of the present invention will become more apparent upon a reading of the following detained description.

DETAILED DESCRIPTION OF THE PREFERRED EMBODIMENT

In the following, a certain preferred embodiment of the present invention will be described with reference to the accompanying drawings. It is to be noted that only a preferred embodiment of the present invention is illustrated by way of example and without limitation, for explanatory convenience.

The electrical connector assembly of the present invention is widely applicable for an electrical connector assembly, as long as it comprises a first connector element supporting a first connector terminal, a second connector element supporting a second connector terminal and being to be mated with the first connector element, and a latch element to be latchingly engaged with the first connector element. For example, the electrical connector assembly of the present invention is widely applicable for a variety of electrical connector assemblies for automobiles.

Figure 1:
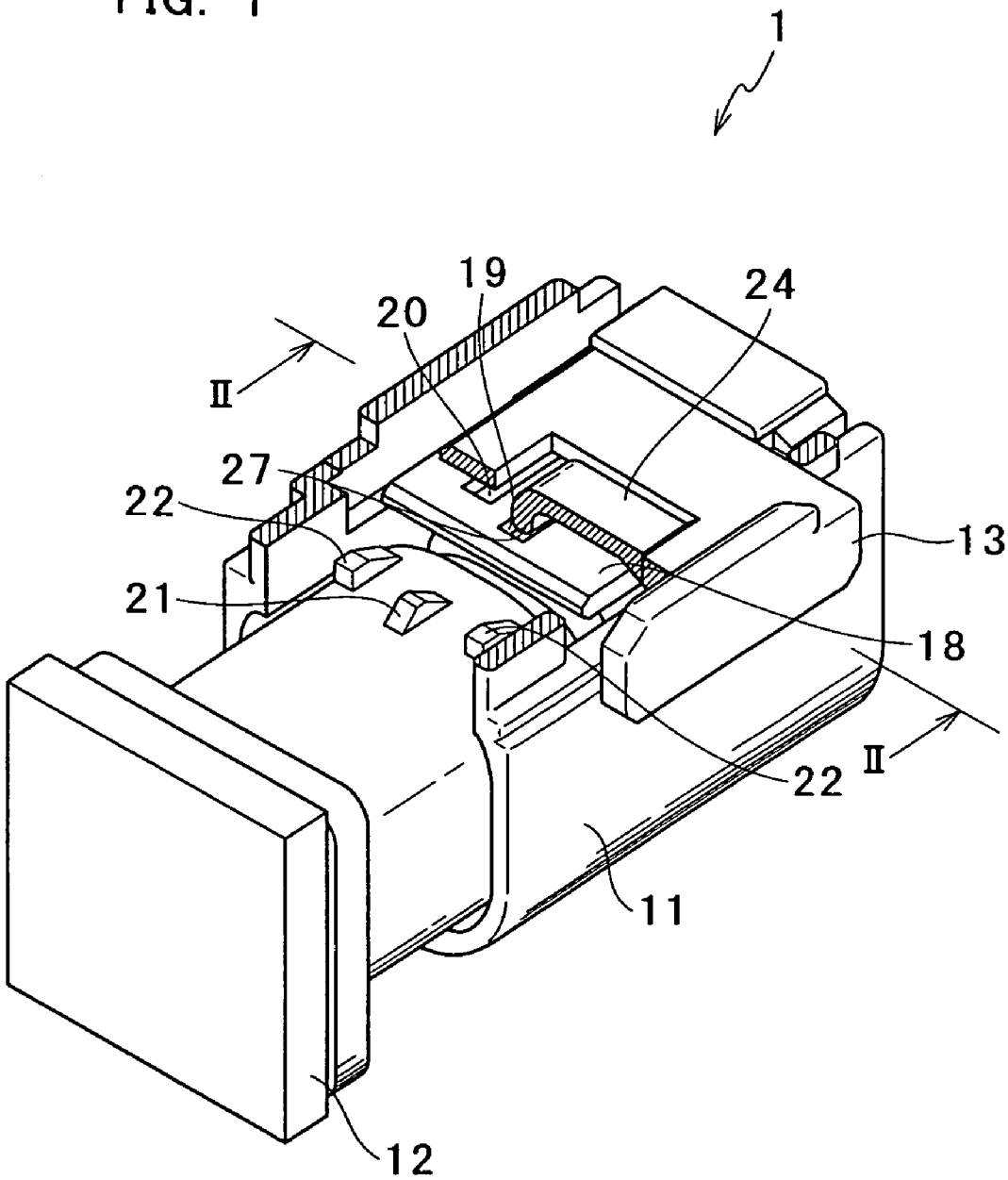
FIG. 1 is a perspective view illustrating an electrical connector assembly according to an embodiment of the present invention.
Figure 2:
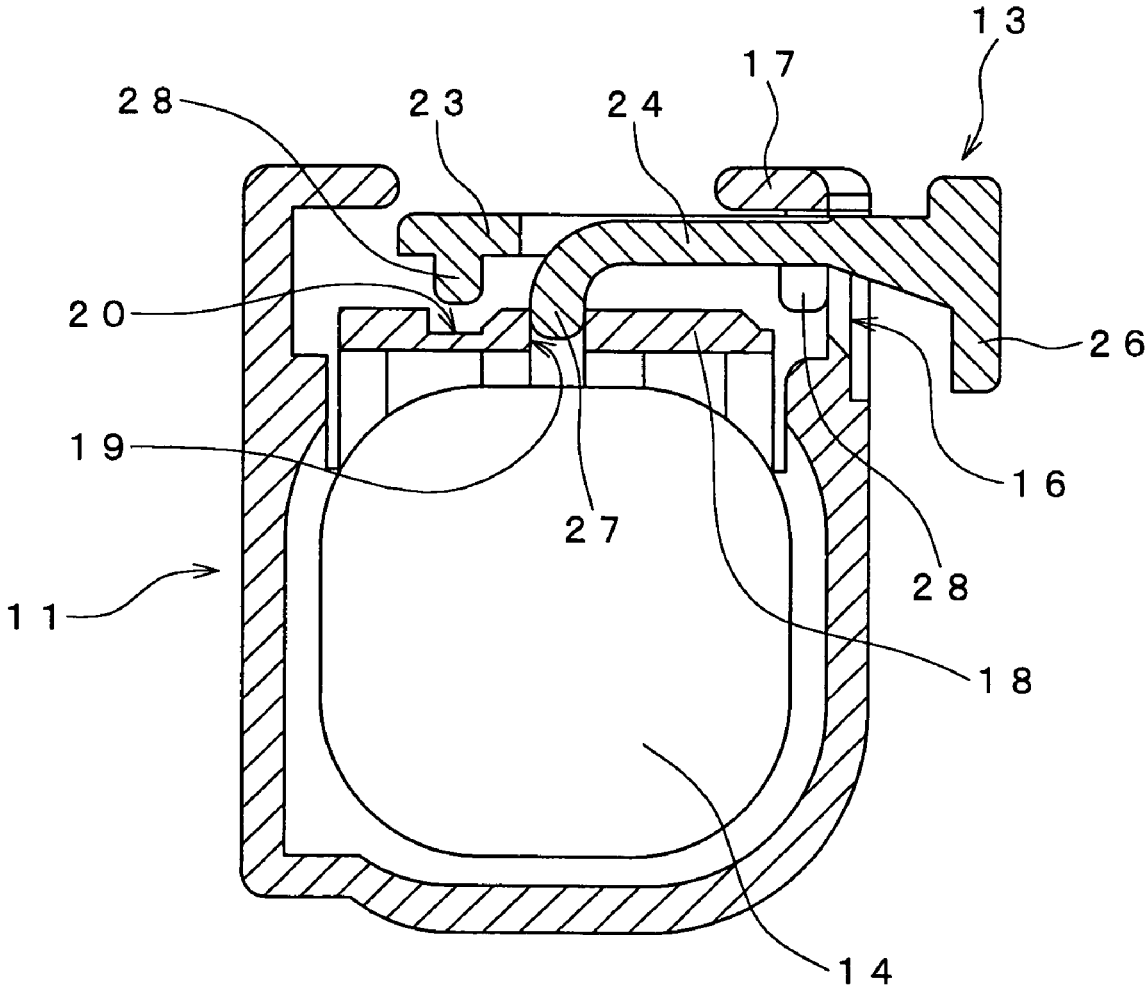
FIG. 2 is a sectional view of the electrical connector assembly taken along line II—II of FIG. 1 as viewed in the direction of arrows.

FIG. 1 is a perspective view illustrating, partly in fragment, an electrical connector assembly 1 according to an embodiment of the present invention. FIG. 2 is a sectional view of the electrical connector assembly taken along line II—II of FIG. 1 as viewed in the direction of arrows. As shown in FIGS. 1 and 2, the electrical connector assembly 1 comprises a first connector element 11, a second connector element 12, and a latch element 13. The first connector element 11 supports a pair of first connector terminals not shown, and the second connector element 12 supports a pair of second connector terminals not shown. By inserting and mating the second connector element 12 in and with the first connector element 11, the first connector element 11 and the second connector element 12 are put into contact with and electrically connected with each other. The first connector terminals and the second connector terminals are connected to their respective lead lines and the like, though not shown.

Figure 7:
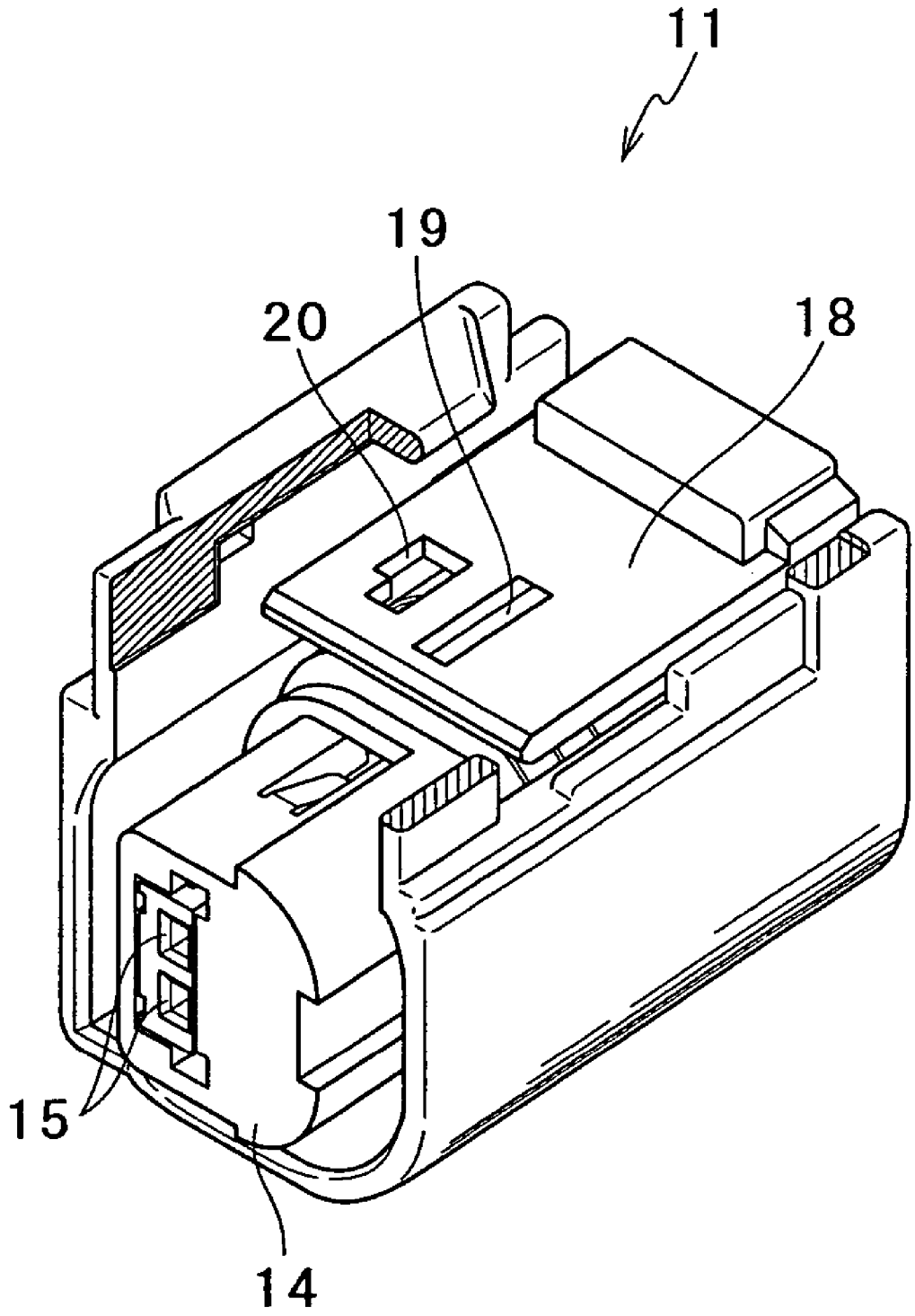
FIG. 7 is a perspective view of the first connector element of the electrical connector assembly shown in FIG. 1.

FIG. 7 is a perspective view, partly in fragment, of the first connector element 11. The first connector element 11 is configured as a female electrical connector formed in a generally cylindrical shape. The first connector element 11 of a generally cylindrical shape includes a terminal accommodating portion 14 projected axially (in a longitudinal direction of the cylindrical configuration), and the first male connector terminals are housed in and supported in the terminal accommodating portion 14. The terminal accommodating portion 14 has a pair of terminal holes 15 formed therein, and the pair of first connector terminals are exposed in the terminal holes 15, respectively. In FIG. 2, a section of the terminal accommodating portion 14 is omitted.

As shown in FIG. 2, the first connector element 11 has an opening 16 to allow for insertion of the latch element 13. The opening 16 is formed in one side surface (on the upper side as viewed in the drawing) of surrounding side surfaces of the first connector element 11, to allow for insertion of the latch element 13 in a direction perpendicular to an axial direction of the first connector element 11.

The opening 16 is formed by an aperture between an outer wall 17 formed at an outside of the first connector element 11 and an inner wall 18 formed at an inner side of the same. The inner wall 18 has a first recessed portion 19 formed as a through hole to allow for latching engagement of the latch element 13. As shown in FIG. 7, the first recessed portion 19 is formed in a rectangular slot shape extending axially of the first connector element 11. The inner wall 18 has a second recessed portion 20 formed on a back side of the opening 16 and extending in parallel with the first recessed portion 19. The second recessed portion 20 is not a through hole, though it may be formed as a through hole.

The second connector element 12 is configured as a male electrical connector, as shown in FIG. 1. The second connector element 12 supports the second connector terminals to be electrically connected with the first connector terminals and is inserted in and mated with the first connector element 11.

The second connector element 12 has a cylindrical opening (not shown) to allow for insertion of the terminal accommodating portion 14 of the first connector element 11 when the second connector element 12 is inserted in the first connector element 11. In the cylindrical opening, the second male connector terminals (e.g. pins) are supported in such a manner as to project axially (longitudinally) therefrom. By inserting and mating the second connector element 12 in and with the first connector element 11, the second male connector terminals are automatically inserted in the terminal holes 15 and connected to the first female connector terminals.

Also, the second connector element 12 has a lug portion 21 formed on a side surface thereof on the side on which the second connector element 12 comes to be opposite to the inner wall 18 when inserted in and mated with the first connector element 11. The lug portion 21 is formed to correspond in position to the first recessed portion 19 when the second connector element 12 is inserted in and mated with the first connector element 11. By virtue of this, when the second connector element 12 is inserted in and mated with the first connector element 11, the first and second connector elements 11, 12 are mated with each other in the condition in which the lug portion 21 and the first recessed portion 19 are engaged with each other. The second connector element 12 has a plurality of protrusions 22 formed on the same side as the side on which the lug portion 21 is formed. The protrusions 22 are arranged to restrain the first connector element 11 from deflecting when the second connector element 12 is inserted in and mated with the first connector element 11.

Figure 8:
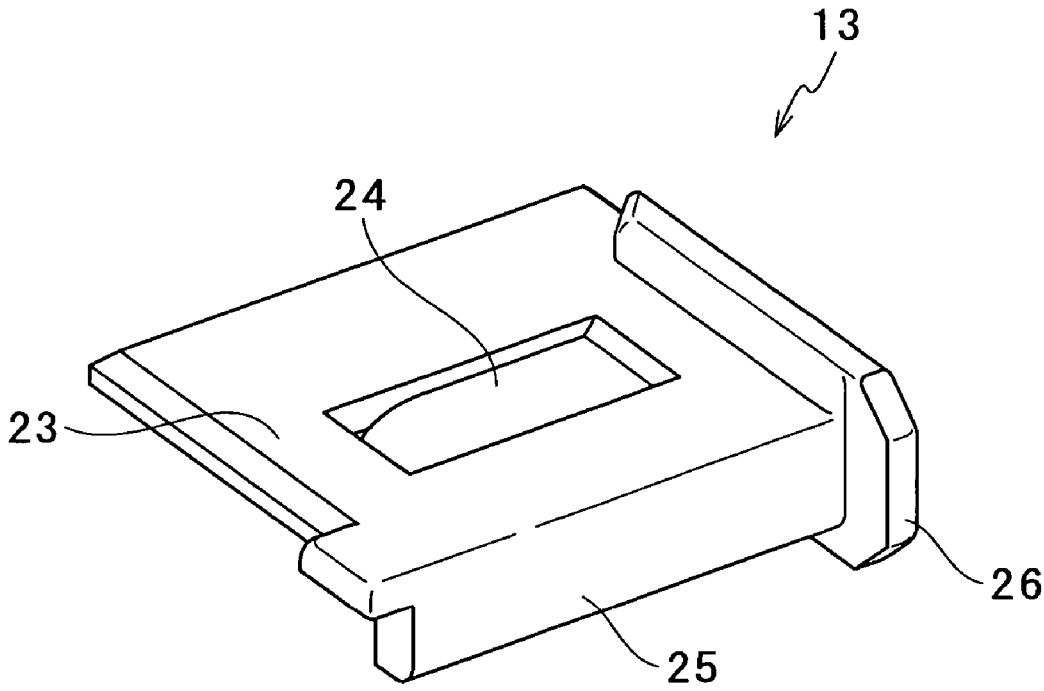
FIG. 8 is a perspective view of the latch element of the electrical connector assembly shown in FIG. 1.
Figure 9:
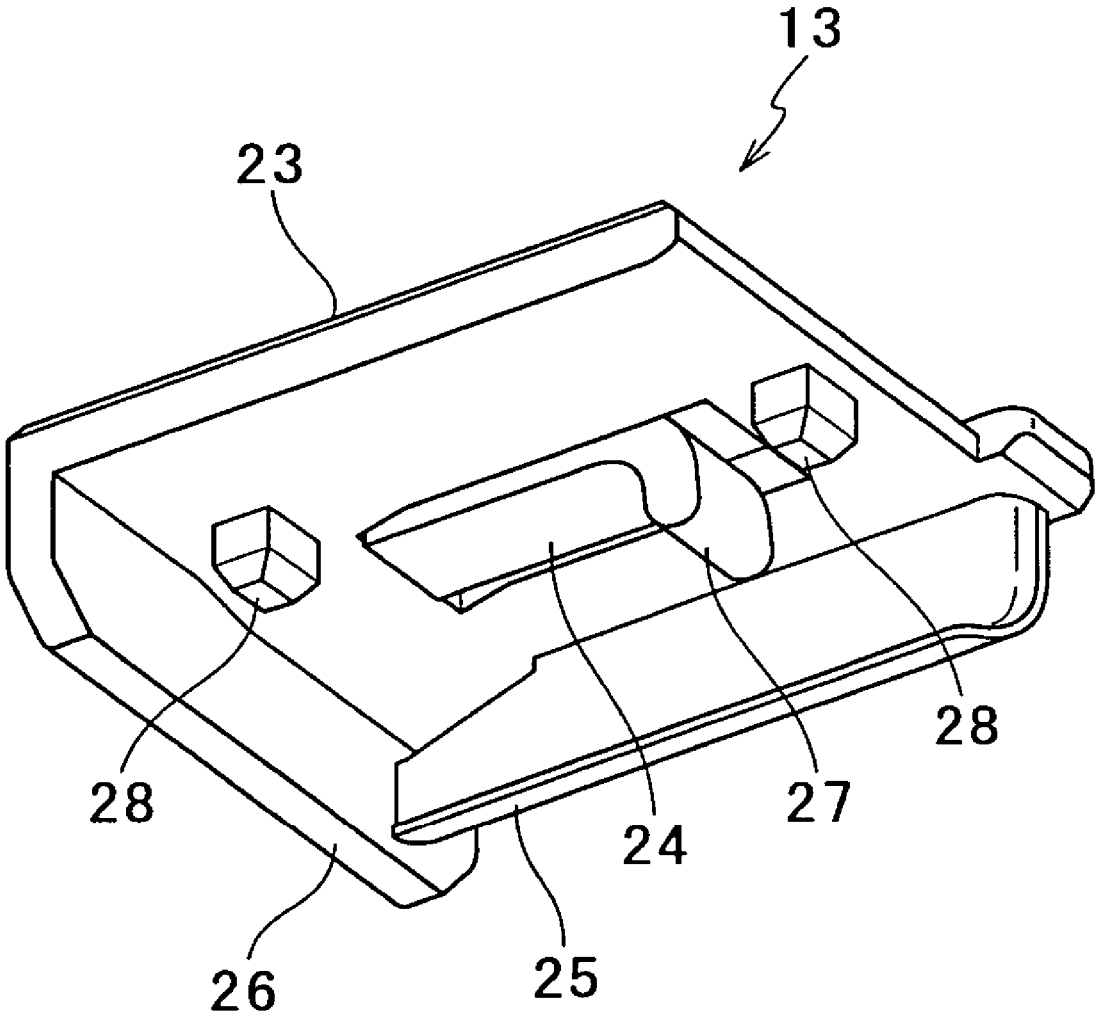
FIG. 9 is a perspective view of the latch element of the electrical connector assembly shown in FIG. 1.

The latch element 13 is inserted in the first connector element 11 from the opening 16 and is latchingly engaged with the first connector element 11, as shown in FIGS. 1 and 2. FIG. 8 is a perspective view of the latch element 13 as viewed from the top, and FIG. 9 is a perspective view of the latch element 13 as viewed from the bottom (reversed to FIG. 8 in a lateral direction). As shown in FIGS. 8 and 9, the latch element 13 comprises a main body portion 23 formed in a planar form and a cantilevered flexible portion 24 formed in a generally center portion of the main body portion 23.

The main body portion 23 has a rectangular planar form, having two vertical walls 25, 26 formed on two sides of the surrounding side walls to have a height smaller than a length. The vertical wall 25 is formed along a direction along which the latch element 13 is inserted in the first connector element 11. When the latch element 13 is inserted in the first connector element 11, this vertical wall 25 is put in sliding connection with an end face of the inner wall 18 of the first connector element 11, serving as a guide for insertion of the latch element 13 into the opening 16. On the other hand, the vertical wall 26 serves as a hand portion to hold the latch element 13 by hand when inserted and also serves as a pressing portion to press the latch element 13 into the opening 16 with finger when inserted. It also form an abutment portion serving as a stopper to abut with a peripheral wall of the first connector element 11 when the latch element 13 is inserted deep into the opening 16.

The cantilevered flexible portion 24 is provided in a generally center portion of the main body portion 23. One end portion of the cantilevered flexible portion 24 is supported by the main body portion 23 and the other end portion of the same is formed to project out as a flexible free end. As shown in FIGS. 1 and 2, when the latch element 13 is inserted in the opening 16, the cantilevered flexible portion 24 is projected out in a direction orthogonal to the insertion direction of the second connector element 12, when viewed in plan configuration. A front end portion at the other end portion of the cantilevered flexible portion 24 is bent in the direction orthogonal to the insertion/mating direction of the second connector element 12. This bent portion of the cantilevered flexible portion 24 forms a first projected portion 27 to be latchingly engaged with the first recessed portion 19 formed in the inner wall 18 when the latch element 13 is inserted in the opening 16. This can provide the result that when the latch element 13 is inserted in the opening 16, the first projected portion 27 at the other end of the cantilevered flexible portion 24 is retained in the first recessed portion 19 of the first connector element 11, whereby the latch element 13 is latchingly engaged with the first connector element 11.

As shown in FIGS. 2 and 9, the latch element 13 has second projected portions 28 projecting out in the same direction as the projecting direction of the first projected portion 27. When the latch element 13 is inserted deep in the opening 16, the second projected portions 28 are brought into contact with the inner wall 18.

The latch element 13 can be retained in and latchingly engaged with the first connector element 11 at two different positions of a first position and a second position which are displaced to one another in the insertion direction of the latch element 13. At the first position, the first projected portion 27 of the latch element 13 is retained in and latchingly engaged with the first recessed portion 19 of the first connector element 11. At the second position, the first projected portion 27 released from the engagement in the first recessed portion 19 is retained in and latchingly engaged in the second recessed portion 20 of the first connector element 11.

Next, operation of the electrical connector assembly 1 will be described.

Referring to FIGS. 1 and 2, there are shown the state in which the first connector element 11 and the second connector element 12 are not yet mated with each other (In FIG. 1, there is shown the state in which the second connector element 12 has started inserting and mating in the first connector element 11). In the state illustrated therein, the latch element 13 is inserted in from the opening 16 and is latchingly engaged in the first connector element 11 at the first position, at which the first projected portion 27 is put in the state of being retained in the first recessed portion 19.

Figure 3:
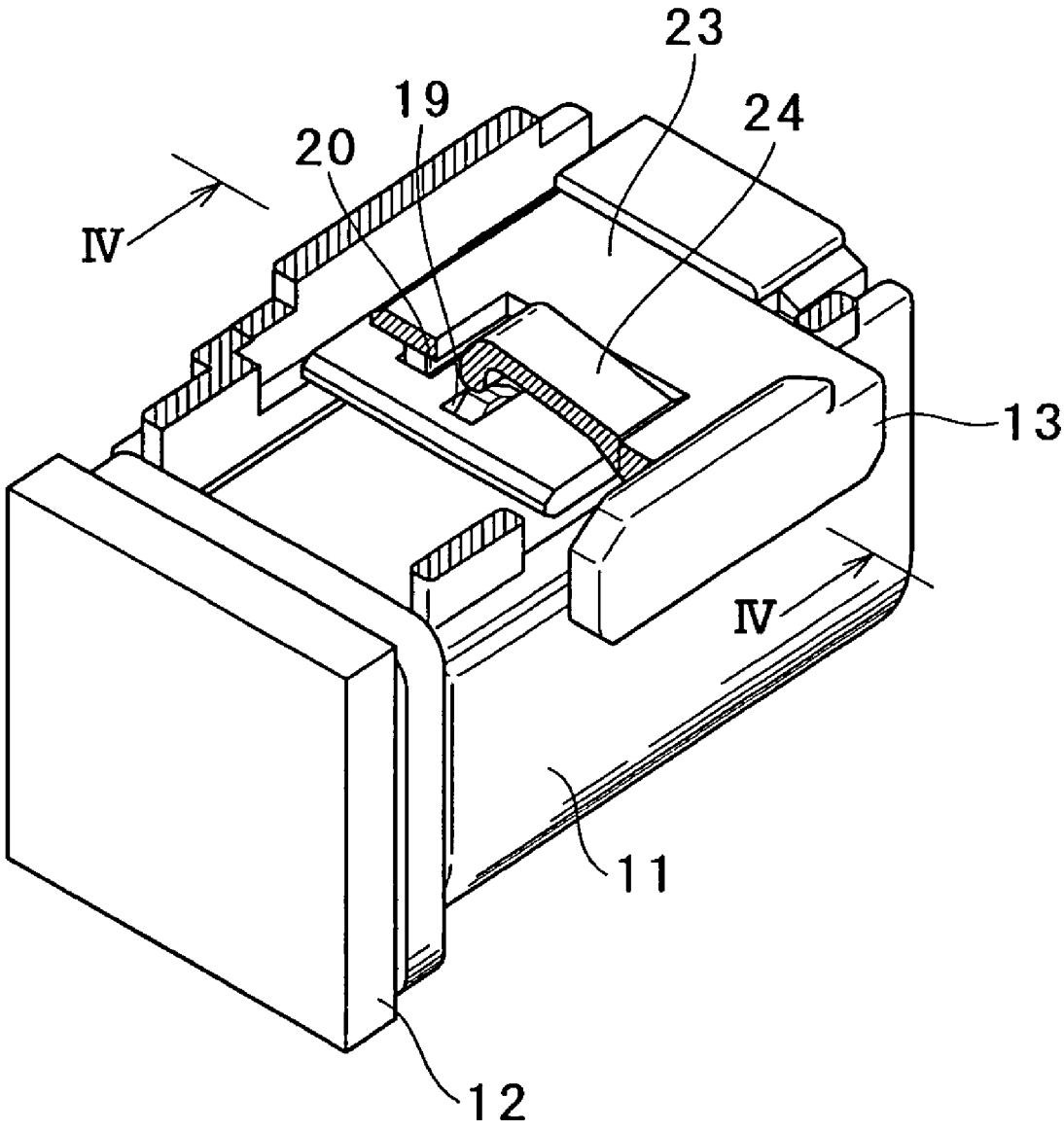
FIG. 3 is a perspective view of the electrical connector assembly shown in FIG. 1, showing the mated state of a first connector element and a second connector element.
Figure 4:
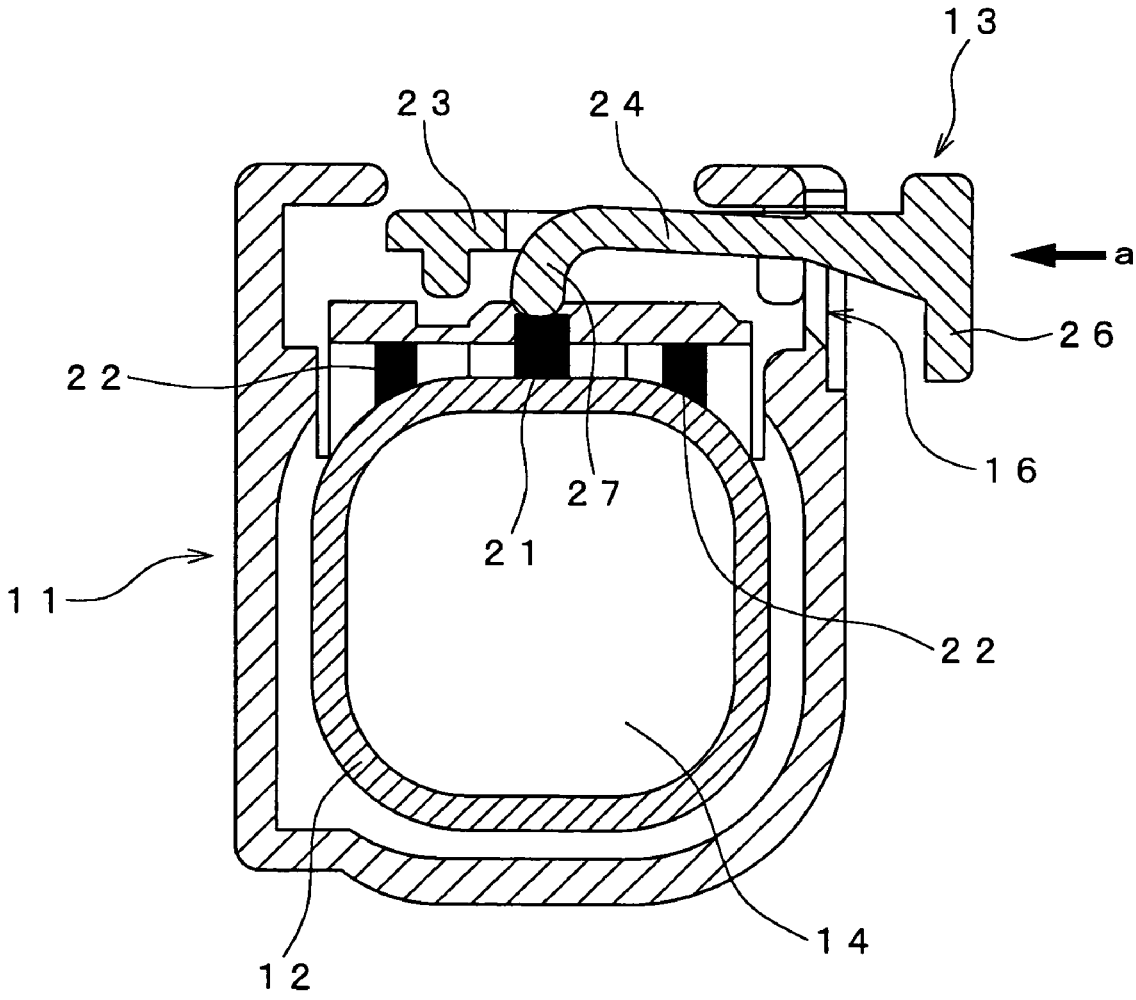
FIG. 4 is a sectional view taken along line IV—IV of FIG. 3 as viewed in the direction of arrows.

When the second connector element 12 is inserted in the first connector element 11 further from the state shown in FIGS. 1 and 2, the state of FIGS. 1 and 2 is changed into the state of FIG. 3 showing a perspective view, partly in fragment, of the electrical connector assembly and of FIG. 4 showing a sectional view taken along line IV—IV of FIG. 3 as viewed in the direction of arrows. As shown in FIGS. 3 and 4, the second connector element 12 is inserted in and mated with the first connector element 11 latchingly engaging with the latch element 13, the first projected portion 27 retained in the first recessed portion 19 is pushed up in the direction orthogonal to the insertion direction of the second connector element 12 by the lug portion 21. Then, the first projected portion 27 is moved in the direction orthogonal to the insertion direction of the second connector element 12, and the retention of the first projected portion 27 in the first recessed portion 19 is released. In other words, when the second connector element 12 is inserted in the first connector element 11, the cantilevered flexible portion 24 is contacted with the second connector element 12 and is deflected to force the first projected portion 27 at the other end portion of the cantilevered flexible portion 24 to move in the direction orthogonal to the insertion/mating direction of the second connector element 12, thereby releasing the engagement of the first projected portion 27 with the first connector element 11.

When the latching engagement of the latch element 13 with the first connector element 11 is released, the latch element 13 is rendered movable in the insertion direction (in a direction indicated by an arrow "a" of FIG. 4). This enables the position for the latch element 13 to latchingly engage with the first connector element 11 to be changed from the first position to the second position.

Along with the release of the latching engagement of the first projected portion 27 with the first recessed portion 19, the lug portion 21 of the second connector element 12 is put into engagement in the first recessed portion 19 from inside. This engagement between the lug portion 21 and the first recessed portion 19 brings the mating of the second connector element 12 with the first connector element 11 into completion. Thus, the mechanical connection between the first connector element 11 and the second connector element 12 can be attained without the aid of the latch element 13. From the result of the latch element 13 being rendered movable in the insertion direction, one can confirm the proper mating engagement of the second connector element 12 in the first connector element 11. For example, from a vertically inverted orientation of the lug portion 21, one can see the wrong orientation of the second connector element 12 with respect to the first connector element 11. Also, one can check on the attainment of the proper mating engagement from a click sound generated when the lug portion 21 is mated with the first recessed portion 19 or from a tactile feel transmitted from a finger contacting with the electrical connector assembly 1 (an instantaneous vibration generated when the lug portion 21 is mated with the first recessed portion 19 with a snap).

Figure 5:
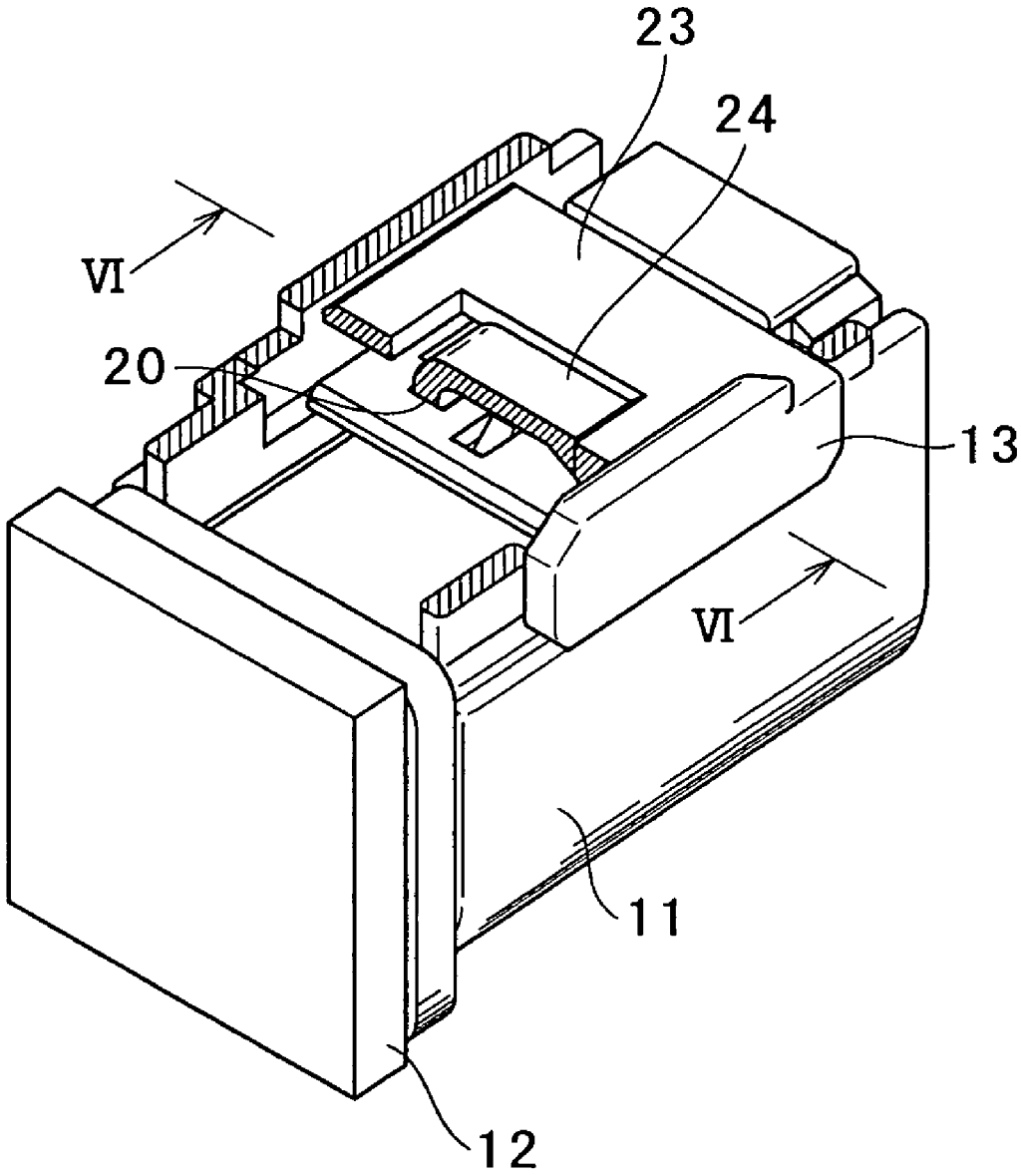
FIG. 5 is a perspective view of the electrical connector assembly shown in FIG. 1, showing the state of a latch element being positioned in a second position.
Figure 6:
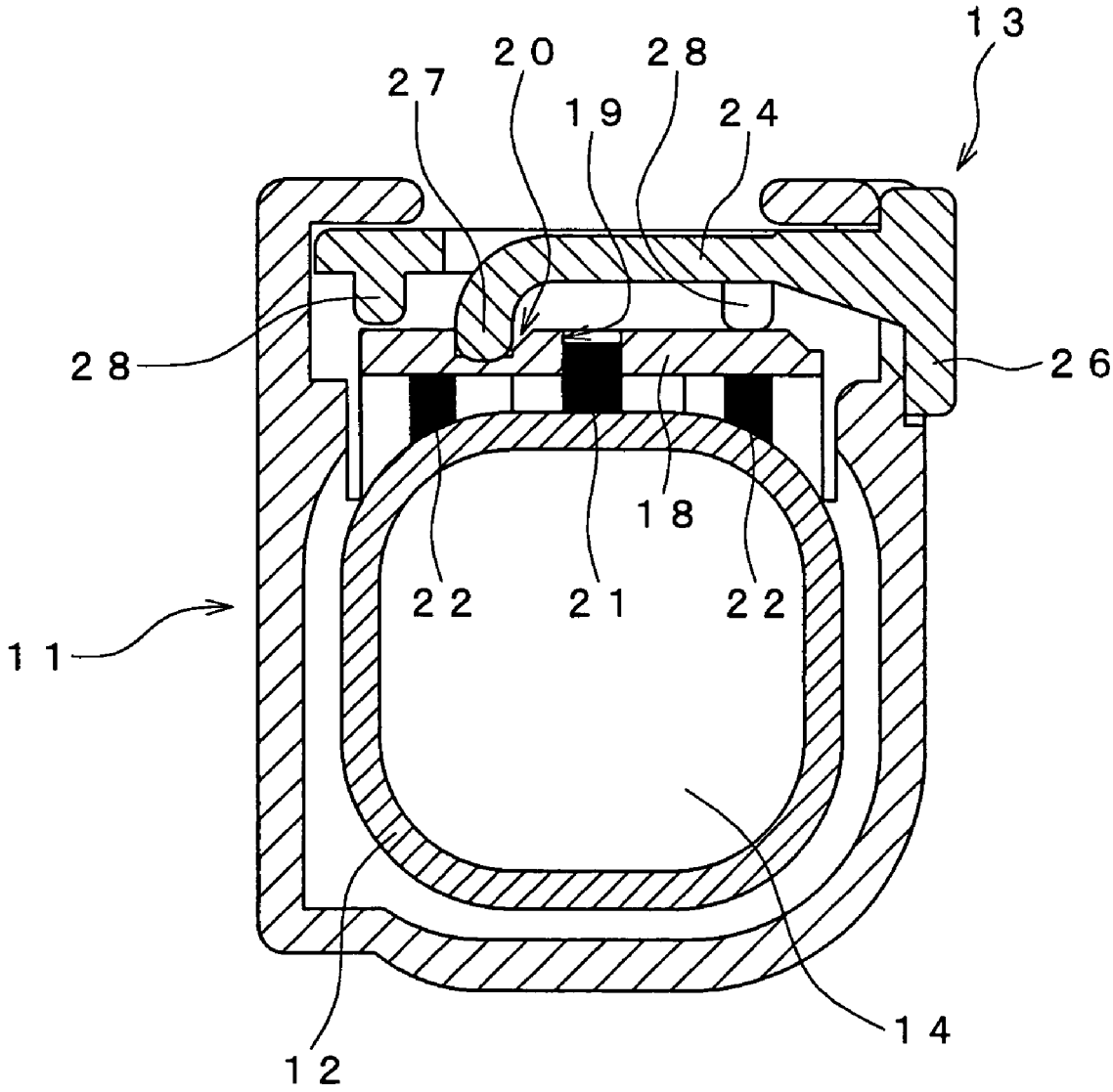
FIG. 6 is a sectional view taken along line VI—VI of FIG. 5 as viewed in the direction of arrows.

When the latch element 13 as was rendered movable in the insertion direction by the mating of the second connector element 12 is pressed toward the back side of the opening 16 (in the direction indicated by the arrow "a" of FIG. 4), the state of FIGS. 3 and 4 is changed into the state of FIG. 5 showing a perspective view (partly in fragment) of the electrical connector assembly and of FIG. 6 showing a sectional view taken along line VI—VI of FIG. 5 as viewed in the direction of arrows (a section of the terminal accommodating portion 14 is omitted from FIG. 6). In this state, the latch element 13 inserted in the back side of the opening 16 is latched at the second position. In other words, the first projected portion 27 at the other end portion of the cantilevered flexible portion 24 is put in the retained state in the second recessed portion 20 of the inner wall 18. When the latch element 13 is in the latchingly engaged state at the second position, the first recessed portion 19 and the lug portion 21 are in engagement with each other, while the plurality of second projected portions 28 are in abutment with the inner wall 18 to restrain the latch element from moving in an engagement releasing direction. This can contribute to a more firm engagement between the first connector element 11 and the second connector element 12.

Also, when the latch element 13 is in the latchingly engaged state at the second position, the vertical wall 26 of the latch element 13 is placed in the position where it abuts with the peripheral wall of the first connector element 11. From this state as well, one can check on the attainment of the proper mating engagement of the first connector element 11 with the second connector element 12.

According to the electrical connector assembly 1 described above, since the engagement releasing direction of the latch element 13 retained in and latchingly engaged in the first connector element 11 is orthogonal to the insertion direction of the second connector element 12, interference with the resilient restoration force of the latch element 13 at the time of insertion of the second connector element 12 can be suppressed drastically. This can produce an electrical connector assembly excellent in workability that can allow easy release of the retention of the latch element in the first connector element to move the latch element in the insertion direction when the second connector element is inserted in and mated with the first connector element.

Also, according to the electrical connector assembly 1, the first recessed portion 19 is formed in the first connector element 11 and the first projected portion 27 to be retained in the first recessed portion 19 is provided at the other end of the cantilevered flexible portion 24. This arrangement can easily achieve the intended construction that can allow release of the retention of the latch element in the first connector element by moving the latch element in the insertion direction when the second connector element is inserted.

According to the electrical connector assembly 1, the lug portion 21 to be engaged with the first recessed portion 19 of the first connector element 11 is provided in the second connector element 12. This arrangement can easily achieve the construction that can allow release of the retention between the first recessed portion 19 and the first projected portion 27 and also can allow engagement between the first connector element 11 and the second connector element 12, when the second connector element 12 is inserted.

According to the electrical connector assembly 1, the opening 16 of the first connector element 11 is formed by a double-wall structure and also the through hole is formed in the inner wall 18. This arrangement can easily achieve the construction that can allow latching engagement of the latch element 13 engageable with the first recessed portion 19 when the latch element 13 is inserted in the opening 16. This can also allow release of the latching engagement by the first projected portion 27 being pushed up from inside of the inner wall 18 when the second connector element 12 is inserted.

According to the electrical connector assembly 1, when the first recessed portion 19 and the lug portion 21 are engaged with each other, the second projected portion 28 is brought into abutment with the inner wall 18 to restrain the latch element 13 from moving in the direction in which the engagement between the first recessed portion 19 and the lug portion 21 is released. This can contribute to a more firm engagement between the first connector element 11 and the second connector element 12.

According to the electrical connector assembly 1, there are provided a plurality of second projected portions 28. This can allow a further firm engagement therebetween.

According to the electrical connector assembly 1, the latch element 13 can be latched at the first position before the second connector element 12 is inserted in the first connector element 11, while also, it can be latched at the second position after it is rendered movable in the insertion direction by the insertion of the second connector element 12.

Also, according to the electrical connector assembly 1, there is provided the arrangement wherein the first projected portion 27 is mated with the first recessed portion 19 at the first position and the first projected portion 27 as was released from the engagement with the first recessed portion 19 is mated with the second recessed portion 20 at the second position. This arrangement can easily achieve the construction that can allow the latch element 13 to be latched at the first position before the insertion of the second connector element 12 and also can allow it to be latched at the second position after the insertion and mating engagement of the second connector element 12.

According to the electrical connector assembly 1, the front end portion at the other end portion of the cantilevered flexible portion 24 is bent in a direction perpendicular to the insertion/mating direction of the second connector element 12. This arrangement can easily achieve the construction that can allow the latch element 13 to be mated with the first connector element 11 and also can allow the latch element 13 mated with the first connector element 11 to be released in the direction perpendicular to the insertion direction of the second connector element 12 by the abutment with the second connector element 12 when the second connector element 12 is inserted.

Although the present invention has been described in its preferred embodiment, it is intended to cover in the appended claims all modifications, applications and equivalents as fall within the scope of the claimed invention that will be made apparent upon reading and understanding the specification.

For example, the present invention may be modified as follows, for practical use.

Although the preferred embodiment having the construction that can allow the engagement of the second connector element in the first connector element and also can allow the release of the engagement between the latch element and the first connector element has been described above, the present invention is not necessarily limited thereto. For example, another construction may be adopted wherein the engagement of the second connector element in the first connector element and the release of the engagement between the latch element and the first connector element are carried out at different positions.

The shape and the position of the first projected portion and the second projected portion of the latch element, the shape and the position of the first recessed portion and the second recessed portion and the opening of the first connector element, and the shape and the position of the lug portion of the second connector element are not limited to those illustrated in the preferred embodiment, but may be modified in various ways without departing from the scope of the claimed invention.

The second projected portions of the latch element and the second recessed portion of the first connector element are not indispensable.

The latch element is not necessarily latched at the two different positions of the first position and the second position. It may be latched at one position or three or more positions.

The first connector terminals supported by the first connector element and the second connector terminals supported by the second connector element are not necessarily taken as one pair. Any proper number of connecter terminals may be arranged for the first connector element and the second connector element.

What is claimed is:

1. An electrical connector assembly comprising:

a first connector element supporting first connector terminals, a second connector element supporting second connector terminals configured to electrically connect to the first connector terminals, wherein the second connector element is configured to be inserted in and mated with the first connector element, and a latch element having a cantilevered flexible portion supported at one end portion and projected to be freely deflectable at a second end portion, wherein when the latch element is inserted in an opening formed in the first connector element in a direction orthogonal to an insertion/mating direction of the second connector element, the second end portion of the cantilevered flexible portion is mated with and latchingly engaged with the first connector element, and wherein when the second connector element is inserted in and mated with the first connector element, which latchingly engages with the latch element, the cantilevered flexible portion contacts the second connector element and is deflected to force the second end portion of the cantilevered flexible portion to move in a direction orthogonal to the insertion direction of the latch element and orthogonal to the insertion/mating direction of the second connector element so as to release the engagement of the latch element with the first connector element, thereby rendering the latch element movable in the insertion direction of the latch element.

2. The electrical connector assembly according to claim 1, wherein when the latch element is inserted in the opening, a first recessed portion formed in the first connector element and a first projected portion provided at the second end portion of cantilevered flexible portion are mated with each other to bring the latch element into latching engagement with the first connector element, and wherein when the second connector element is inserted in and mated with the first connector element, the first projected portion is moved in the direction orthogonal to the insertion/mating direction of the second connector element to allow release of retention of the first projected portion from the first recessed portion.

3. The electrical connector assembly according to claim 2, wherein when the second connector element is inserted in and mated with the first connector element, a lug portion projecting from the second connector element is engaged with the first recessed portion to put the first and second connector elements into mating engagement with each other and the first projected portion retained in the first recessed portion is pushed up in the direction orthogonal to the insertion/mating direction of the second connector element by the lug portion to allow release of retention of the first projected portion from the first recessed portion.

4. The electrical connector assembly according to claim 2, wherein the opening of the first connector element is formed by an aperture between an outer wall formed at an outside of the first connector element and an inner wall formed at an inside of the first connector element, and the first recessed portion is formed as a through hole in the inner wall.

5. The electrical connector assembly according to claim 4, wherein the latch element has a second projected portion that abuts with the inner wall when the first recessed portion and the lug portion are engaged with each other to restrain the latch element from moving in a direction in which the engagement between the first recessed portion and the lug portion is released.

6. The electrical connector assembly according to claim 5, wherein there are a plurality of second projected portions.

7. The electrical connector assembly according to claim 1, wherein the latch element can be retained in and latchingly engaged with the first connector element at a first position and a second position, which are displaced relative to one another in the insertion direction of the latch element.

8. The electrical connector assembly according to claim 1, wherein the latch element can be retained in and latchingly engaged with the first connector element at a first position and a second position, displaced relative to one another in the insertion direction of the latch element, and wherein the first projected portion is retained in the first recessed portion at the first position, and the first projected portion is retained in and latchingly engaged with a second recessed portion formed in the first connector element at the second position when released from retention in the first recessed portion.

9. The electrical connector assembly according to claim 1, wherein a front end portion at the second end portion of the cantilevered flexible portion is bent in the direction orthogonal to the insertion/mating direction of the second connector element.

* * * * *